United States Patent [19]

Harwick et al.

[11] Patent Number: 4,712,793

[45] Date of Patent: Dec. 15, 1987

[54] WEIGHT MAXIMIZER

[76] Inventors: Milton C. Harwick, 3205 S. 3rd St., Whitehall, Pa. 18052; George Spector, 233 Broadway, Rm. 3615, New York, N.Y. 10007

[21] Appl. No.: 839,639

[22] Filed: Mar. 14, 1986

[51] Int. Cl.[4] ..... A63B 21/06

[52] U.S. Cl. ..... 272/118; 272/117; 272/DIG. 4

[58] Field of Search ..... 272/117–124, 272/134, DIG. 4

[56] References Cited

U.S. PATENT DOCUMENTS

| | | | |
|---|---|---|---|
| 3,758,109 | 9/1973 | Bender | 272/123 |
| 3,785,646 | 1/1974 | Ruskin | 272/119 |
| 4,085,934 | 4/1978 | Churchward | 273/171 |
| 4,384,714 | 5/1983 | Kimura | 272/119 |
| 4,515,364 | 5/1985 | Rotella | 272/122 X |
| 4,538,805 | 9/1985 | Parviainen | 272/118 |

*Primary Examiner*—Richard J. Apley
*Assistant Examiner*—Robert W. Bahr
*Attorney, Agent, or Firm*—Ruth Moyerman

[57] ABSTRACT

A weight adjustable base unit for a weight lifting device is provided and consists of a plurality of cylinder shaped weights, each being detachably inserted in holes of a pair of base plates which are secured on uppermost of adjustable weights of the weight lifting device so as to more precisely adjust the weight lifting device.

6 Claims, 6 Drawing Figures

WEIGHT MAXIMIZER

BACKGROUND OF THE INVENTION

The instant invention relates generally to exercising devices and more specifically it relates to a weight adjustable base unit for a weight lifting device.

Numerous exercising devices have been provided in prior art that are adapted to include a plurality of interchangeable weights therein. For example, U.S. Pat. Nos. 777,478; 3,438,627 and 4,384,714 all are illustrative of such prior art. While these units may be suitable for the particular purpose to which they address, they would not be as suitable for the purposes of the present invention as heretofore described.

SUMMARY OF THE INVENTION

A principle object of the present invention is to provide a weight adjustable base unit for a weight lifting device that will overcome the shortcomings of the prior art devices.

Another object is to provide a weight adjustable base unit for a weight lifting device that will allow user to increase the amount of weight from the manufacturer's minimum weight by half pound increments and the maximum weight to be increased twelve pounds over the manufacturer's maximum weight so that the user will have a more precise control over any given exercise.

An additonal object is to provide a weight adjustable base unit for a weight lifting device that can be safely secured to the uppermost weight of the device so that proper operation of the device can be obtained by the user.

A further object is to provide a weight adjustable base unit for a weight lifting device that is simple and easy to use.

A still further object is to provide a weight adjustable base unit for a weight lifting device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
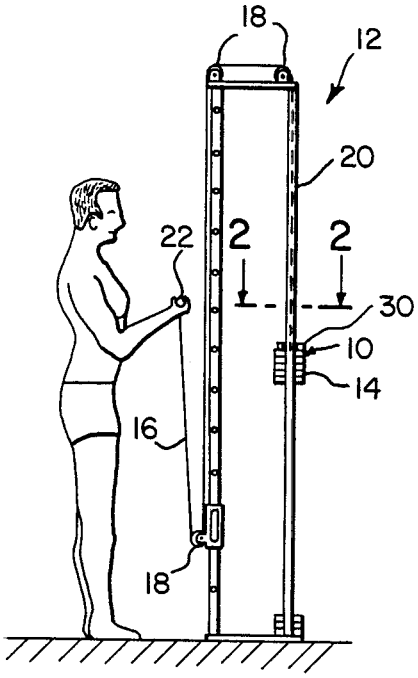
FIG. 1 is a side view of a typical weight lifting device with the invention installed therein.
Figure 2:
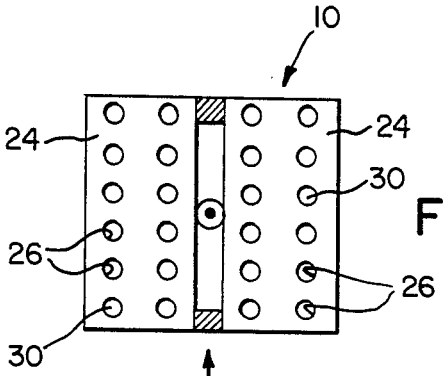
FIG. 2 is an enlarged cross sectional view taken along line 2—2 in FIG. 1.
Figure 3:
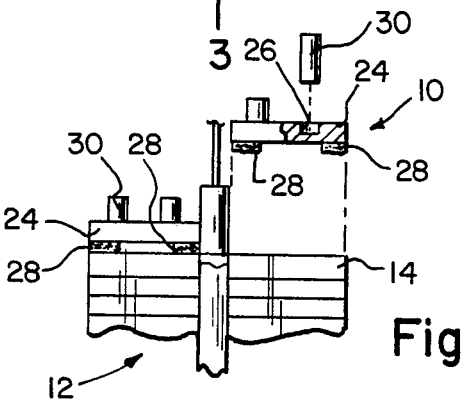
FIG. 3 is an enlarged partial side view with parts broken away as indicated by numeral 3 in FIG. 2.

Turning now descriptively to the drawings, in which similar reference characters denote similar elements throughout the several views, FIGS. 1 through 3 illustrates a weight adjustable base unit 10 for a weight lifting device 12 of the type that has adjustable weights 14 connected to one end of a cable 16, the cable trained over various pulleys 18 on a frame 20 and a handgrip 22 connected to other end of the cable 16.

The base unit 10 consists of a pair of base plates 24, each of which has a plurality of holes 26 therein. Two-sided adhesive tape 28 is for securing the base plates 24 on uppermost of the adjustable weights 14 of the weight lifting device 12. A plurality of cylinder shaped weights 30 are provided, each of which is detachably inserted in the holes 26 of the base plates 24 so as to more precisely adjust the weight lifting device 12.

For the best ideal condition each of th base plates 24 should have twelve holes 26 therein and each of the cylinder shaped weights 30 should be one half pound.

Figure 4:
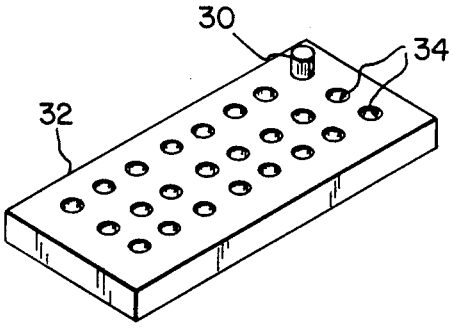
FIG. 4 is a perspective view of a storage unit to hold the half pound weights which are not being used.

FIG. 4 shows a storage unit 32 that has a plurality of holes 34 therein for holding the cylinder shaped weights 30 which are not being used.

Figure 5:
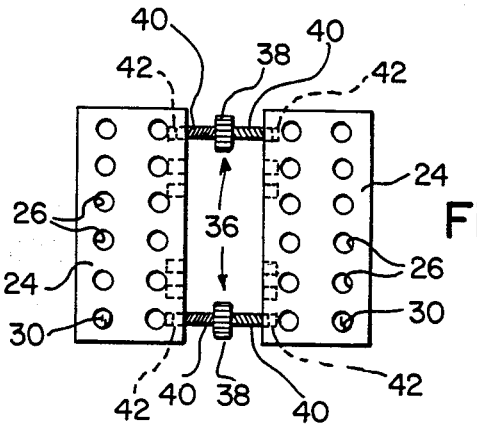
FIG. 5 is a top plan view of a modification showing clamp holding devices being turn bolts to hold the two base units together.

FIG. 5 shows a clamp holding device 36 that includes two turn bolts 38, each of which has two reverse threaded shafts 40 to threadably engage within edges of the pair of base plates 24 that have holes 42 to secure the base plates together.

Figure 6:
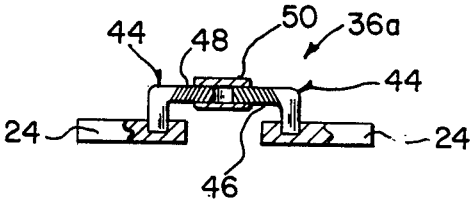
FIG. 6 is a side view of a further modification with parts broken away showing another type of clamp holding device which includes two L-shaped shafts with a reverse threaded sleeve therebetween.

FIG. 6 shows another type of clamp holding device 36a which includes two L-shaped shafts 44. One has a right threaded end 46 and other has a left threaded end 48. A reverse threaded sleeve 50 is provided to engage with the right threaded end 46 and the left threaded end 48. The other ends 52 of the two L-shaped shafts 44 are inserted in one of the opposite holes 26 in each of the base plates 24 so that the sleeve 50 can be turned to secure the base plates together. The L-shaped shafts 44 and the sleeve 50 should weigh a total of one pound so as to replace two of the cylinder shaped weights 30.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A weight adjustable base unit for a weight lifing device of the type having adjustable weights connected to one end of a cable, the cable trained over various pulleys on a frame and a handgrip connected to other end of the cable, said base unit comprising:

(a) a pair of base plates, each said plate having two sides and a plurality of holes therein;

(b) a clamp holding device being at least one turn bolt having two reverse threaded shafts to threadably engage within edges of said pair of base plates having holes to secure said base plates together;

(c) two-sided adhesive tape secured on one tape side to one side of each of said base plates and on said other tape side to the top of the uppermost of said ajustable weights; and (d) a plurality of cylinder shaped weights, each being detachably inserted in said holes of said base plates so as to more preceisely adjust said weight lifting device.

2. A weight adjustable base unit as recited in claim 1, wherein each of said base plates has twelve holes therein and each of said cylinder shaped weights is about one half pound.

3. A weight adjustable base unit as recited in claim 2, further comprising a storage unit having a plurality of holes therein for holding said cylinder shaped weights which are not being used.

4. A weight adjustable base unit for a weight lifting device of the type having stacked adjustable weights connected to one end of a cable, the cable trained over various pulleys on a frame and a handgrip connected to other end of the cable, said base unit comprising:

(a) a pair of base plates, each said plate having two sides and a plurality of holes therein;

(b) a clamping device to hold said plates together, said clamping device including;

(i) two L-shaped shafts, one having a right threaded end and the other having a left threaded end; and, (ii) a reverse threaded sleeve to engage with said right threaded end and said left threaded end with the other ends of said two L-shaped shafts inserted in one of said opposite holes in each of said base plates so that said sleeve can be turned to secure said base plates togeher;

(c) two sided adhesive tape, one said tape side secured on one tape side to one side of each of said base plates, said other tape side secured to the top of the uppermost of said stacked weights; and (d) a plurality of cylinder shaped weights, each being detachably inserted in said holes of said base plates so as to more precisely adjust said weight lifting device.

5. A weight adjustable base unit as recited in claim 4 wherein each of said base plates has twelve holes therein and each of said cylinder shaped weights is about one half pound.

6. A weight adjustable base unit as recited in claim 5 including, additonally, a storage unit having a plurality of holes therein for holding said cylinder shaped weights which are not being used.

* * * * *